US006766864B2

(12) United States Patent
Clauss et al.

(10) Patent No.: US 6,766,864 B2
(45) Date of Patent: Jul. 27, 2004

(54) FIRE-EXTINGUISHING SPRAYER WITH DYNAMIC CONTROL

(75) Inventors: Torsten Clauss, Heidestrasse 56, D-10557, Berlin (DE); Andreas Schmidt, Bestensee (DE); Wassili Jansen, Berlin (DE)

(73) Assignee: Torsten Clauss, Berlin (DE)

( * ) Notice: Subject to any disclaimer, the term of this patent is extended or adjusted under 35 U.S.C. 154(b) by 0 days.

(21) Appl. No.: 10/220,236

(22) PCT Filed: Feb. 27, 2001

(86) PCT No.: PCT/DE01/00808

§ 371 (c)(1),
(2), (4) Date: Oct. 15, 2002

(87) PCT Pub. No.: WO01/64291

PCT Pub. Date: Sep. 7, 2001

(65) Prior Publication Data

US 2003/0080213 A1 May 1, 2003

(30) Foreign Application Priority Data

Feb. 29, 2000 (DE) ..... 100 10 880

(51) Int. Cl.[7] ..... B05B 7/06

(52) U.S. Cl. ..... 169/46; 239/472; 239/590; 169/46

(58) Field of Search ..... 239/11, 432, 472, 239/590, 590.3, 590.5, 599; 169/46

(56) References Cited

U.S. PATENT DOCUMENTS 2,531,789 A 11/1950 Rowley
2,785,926 A 3/1957 Lataste
4,128,206 A * 12/1978 Bintner ..... 239/11
4,405,087 A * 9/1983 Mata-Garza ..... 239/226

FOREIGN PATENT DOCUMENTS

DE 100 10 880 10/2001
EP 0 671 216 9/1995

* cited by examiner

*Primary Examiner*—Michael Mar
*Assistant Examiner*—Thach H Bui
(74) *Attorney, Agent, or Firm*—Herbert Dubno; Andrew Wilford

(57) ABSTRACT

The invention relates to a method and a device for distributing liquid media, in particular extinguishing fluids. The aim of the invention is to provide a method and a device of the aforementioned type which can be used to produce a fine mist of small droplets and a jet spray of large droplets at separate moments, at approximately the same operating pressure of the extinguishing fluid, depending on the outbreak and the development of the fire, whilst at the same time minimising water consumption, reducing water damage caused during a fire and increasing cost-effectiveness, by creating a modular system which can be universally installed. To achieve this, the intensity of the vortex and the proportion of fine or large droplets in the spray cone is adjusted by regulating the quantity and speed of the flow during the distribution of the extinguishing fluid in at least two sub-streams and by combining said sub-streams with at least one additional sub-stream. In addition, the adjusting process is controlled by a signal generator which responds to the outbreak and dynamic development of the fire.

20 Claims, 8 Drawing Sheets

FIRE-EXTINGUISHING SPRAYER WITH DYNAMIC CONTROL

CROSS REFERENCE TO RELATED APPLICATIONS

This application is the US phase of PCT application PCT/DE01/00808 filed Feb. 27, 2001 and claiming the priority of German application 100 10 890.6 itself filed 29 Feb. 2000.

FIELD OF THE INVENTION

The invention relates to a method of distributing liquid media, in particular extinguishing liquids like water or the like in the form of a mist or a large-droplet stream from an open line fed by a low-pressure supply line into spaces, in particular living or household rooms or the like to fight fire where the pressurized extinguishing liquid is made into individual streams and these streams are separately set in rotation and as a result the streams are combined to form a spray cone.

The invention further relates to an apparatus for carrying out the above-described method with a support on which is provided a fitting for connection to an open line connected via a shutoff valve with a supply, a flow body that is traversed by a flow passage, and a turbulence chamber surrounding the flow body, the flow passage being continuously filled and the turbulence chamber being filled as needed with the separate streams of the extinguishing liquid.

BACKGROUND OF THE INVENTION

Such a dry sprinkler nozzle for making spray mists in low-pressure systems, in particular for fighting fire within stationary water-mist fire-extinguishing systems, is known from EP 0 671 216. This known nozzle is built radially into a pipe of a fire-extinguishing system and is comprised of a housing holding a flow body that traversed by a conically tapering turbulence/mixing chamber. The surface of this turbulence/mixing chamber is formed with spiral grooves with axial inlets that communicate with inlet openings for the water. An annular apace permits a further stream of water into the inner turbulence/mixing chamber. There is thus stream separation. The one path leads via the inlet openings and the twist passages to cylindrical nozzle openings and there produces and inner spray cone. The second path extends via the annular chamber and tangential bores to an annular gap from which the water exits as an outer spray cone.

The known solution serves mainly for applying a large-droplet inner spray stream and a fine-droplet outer spray stream. It is not possible to obtain an initial fine-drop spray mist when the fire starts and a large-droplet spray mist when the fire is under way to apply the extinguishing media in a variably controlled manner over time.

This leads in a fire mainly to usage of a great deal of water by the stationary extinguishing system with all the inherent disadvantages of overdimensioning the pumps, pipes, and storage containers for extinguishing media in the system. A further not inconsequential disadvantage of the prior art is that the resultant water damage can completely destroy the protected property.

OBJECT OF THE INVENTION

Starting from this state of the art it is an object of the invention to provide a method and apparatus of the above-described type by means of which it is possible with nearly constant supply pressure of the extinguishing means to, with time, in accordance with the whether the fire has just started or is under way, to apply a fine-droplet spray mist and a large-droplet spray mist so as to minimize water use, reduce water damage in fire, and increase the efficiency of the fire-extinguishing system in any installation.

SUMMARY OF THE INVENTION

This object is attained by a method and an apparatus of the above-described type wherein the turbulence intensity and the ratio of small and large droplets in the spray are adjusted between zero and a maximal value by adjusting the flow volume and the flow speed of at least two streams of the extinguishing liquid and joining these streams with at least one other stream, and the adjustment operation is controlled dynamically in accordance with development of the fire.

The invention is characterized above all by its simplicity and is particularly applicable to wet systems. In contrast to the known state of the art, a simple flow regulation in the separated and rejoined streams of the extinguishing fluid produces an excellent influencing of the turbulence intensity depending on whether the fire has just started or is under-way. When the streams are produced it is further possible to impinge small and large surfaces of an object to be protected with spray cones and spray streams of different shape and composition.

According to the above-given requirements, as a fire starts up, the apparatus according to the invention produces at first a mist-like droplet stream. The signal generator can in this case be a smoke detector. As the fire develops a large-droplet spray stream in needed so a further detector, for instance a heat detector, produces a signal which acts on the adjuster of the apparatus in that the flow cross section of the opening of the slot is enlarged.

The solution according to the invention reduces water use to fight a fire substantially and simultaneously reduces water damage caused by the unregulated outflowing of the extinguishing medium. The fire-extinguishing systems can be better tailored to the dynamics of the fire as it starts and develops.

A further particular advantage of the solution according to the invention is that as a result of the plate-like construction of the support and the variation of the flow body, the system is modular so that it can easily be set up with no problems to comply with the various requirements of existing or new fire-extinguishing systems.

BRIEF DESCRIPTION OF THE DRAWING

Further advantages and details can be seen in the following description with reference to the attached drawings. The invention is more closely described below with reference to a specific embodiment. Therein.

SPECIFIC DESCRIPTION

Figure 1:
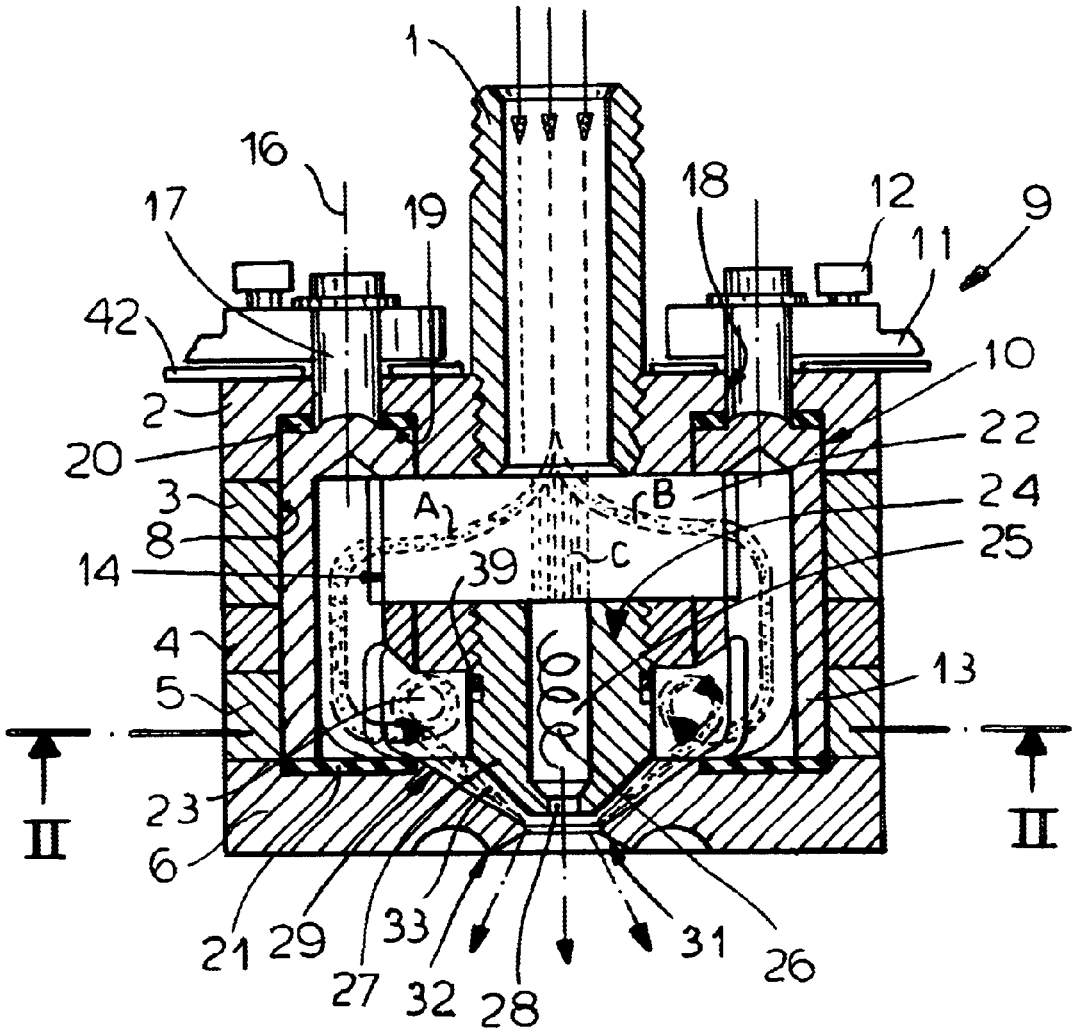
FIG. 1 is a side sectional view of the apparatus according to the invention, the stream flow being shown.

The apparatus according to the invention is comprised as shown in FIG. 1 of a support body provided with an inlet fitting 1 and itself formed of a top plate 2, a distributing-chamber ring 3, a spacer plate 4, a turbulence-chamber ring 5, and an outlet plate 6, all secured by unillustrated screws in bolt holes 7 extending through all the plates and rings. The inlet 1 is screwed centrally into the top plate 2. The top plate 2 and the spacer plate 4 contain structure forming passages 8 adjustable by respective adjusters 9. The adjusters 9 are each comprised of a hollow sleeve-like body 10 cloned at both ends, an adjustment arm 11 coupled with the hollow body 10 and a brake mechanism 12 or setting mechanism 42. A wall 13 of each hollow body 10 is formed with two axially aligned slot openings 14 and 15 (see FIGS. 2 and 3). The hollow body 10 has on its upstream end near the inlet 11 a pin 17 defining an axis 16 and extending out through a hole 18 in the top plate 2. The pin 17 carries the adjustment art 11 which can be fixed angularly by the brake mechanism 12.

Figure 3:
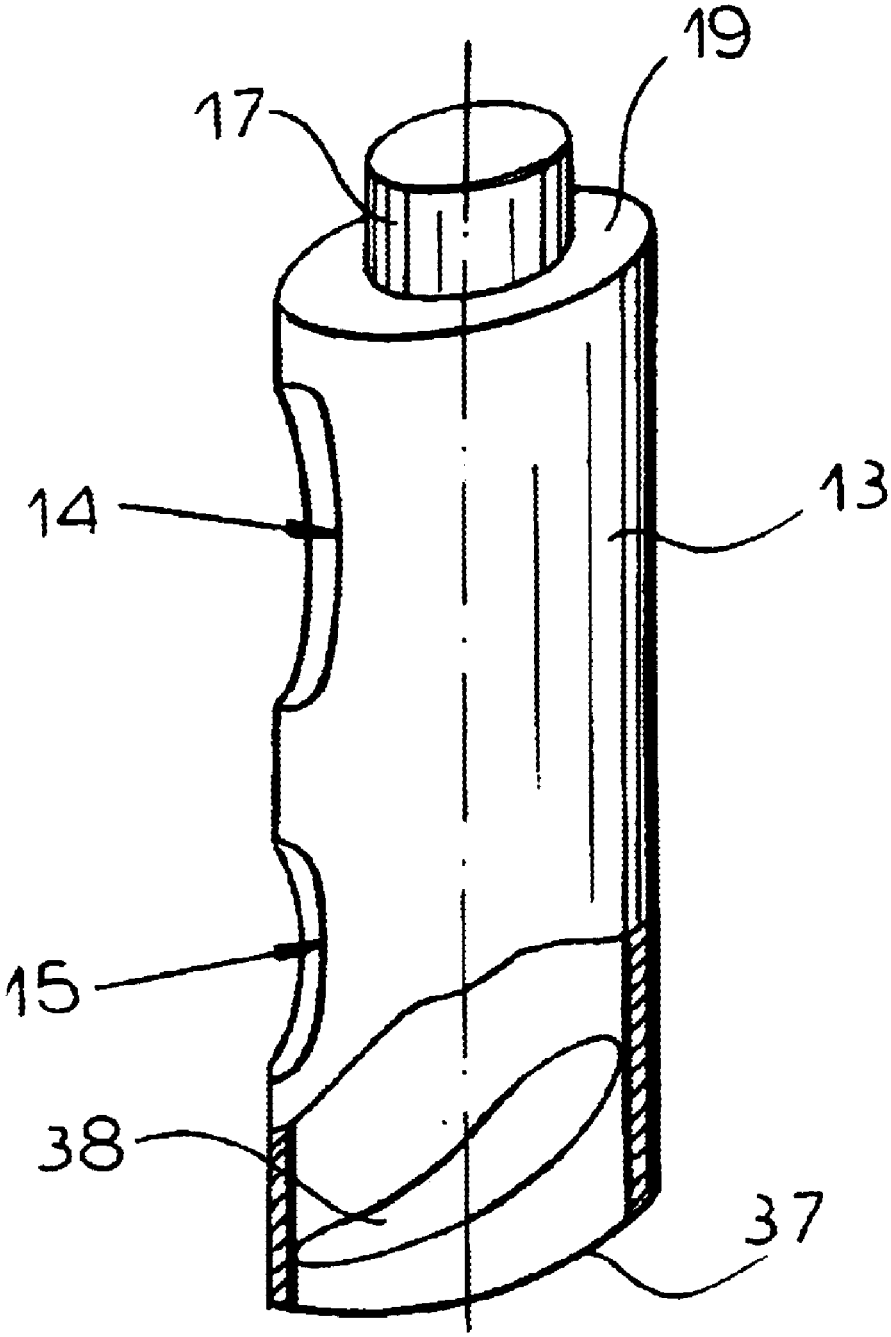
FIG. 3 is a perspective view of the housing.

The distributing-chamber ring 3 and the turbulence-chamber ring 5 are of the same axial heights as the respective slots 14 and 15. The axial height of the spacer plate 4 corresponds generally to the spacing between the vertically spaced slots 14 and 15. FIG. 3 shows the position of the slots 14 and 15 of the hollow body 10 in perspective. In this embodiment the hollow body 10 is fitted with a plug-like insert 37 which is internally formed as a flow deflector with an angled upper surface 38.

The pin 17 is in this embodiment of somewhat smaller diameter than the hollow body 10 so that the hollow body 10 has a shoulder 19 on which sits a seal washer 20 that supports and seals the hollow body 10 with respect to the top plate 2. The hollow body 10 thus passes through the distributing-chamber ring 3, the spacer plate 4, and the turbulence-chamber ring 5 and sits on a seal/bearing disk 21 seated in the outlet plate 6. On rotation of the pins 17 about the hollow-body axes the angular positions of the slots 14 change relative to a distributing chamber 22 formed by the distributing-chamber ring 3 as does the flow cross section of the slot 14. The flow cross section of the slot openings 15 into a turbulence chamber 23 are similarly changed.

Axially centered on the inlet 1 in the spacer plate 4 is a cylindrical flow body 24 with a central throughflow passage 25, screw-mounted so as to be vertically axially adjustable. This is done by simply providing a snap ring 29. The flow body 24 has a frustoconical head 27 with an outlet opening 28 that is internally also frustoconical. The head 27 of the flow body 24 extends into a funnel-shaped opening 29 of the output plate 6 that is flared into the turbulence chamber 23 and ends in an outlet opening 30 formed with an outlet flare 31 ending at a separation edge 32. The outlet flare 31 can be of frustoconical or other shape. The head 27 and opening 28 form a funnel-shaped passage 33 whose flow cross section can be changed by adjusting the height of the flow body 24 in the spacer plate 4.

The water admitted by the inlet 1 is distributed as shown in FIG. 1 in the distributing chamber 22 into three streams A, B, and C. The two outer streams A and B pans through the open slots 14 of both adjusters 9 into the hollow bodies 10, then flow through the open slots 15 tangentially into the turbulence chamber 23 where they mix together and flow together into the funnel-shaped passage 33. The two joined streams A and B exit from the outlet opening 30 of the outlet plate 6.

The third stream C moves in the central throughflow passage 25 and is set to rotate by a spiral guide 26, then leaves the opening 28 of the flow body 27 and joins the two mixed-together streams A and B. Tho joining of the rotating stream C from the throughflow passage 25 ensures a uniform distribution of the spray droplets in the spray cone that is produced.

Figure 2:
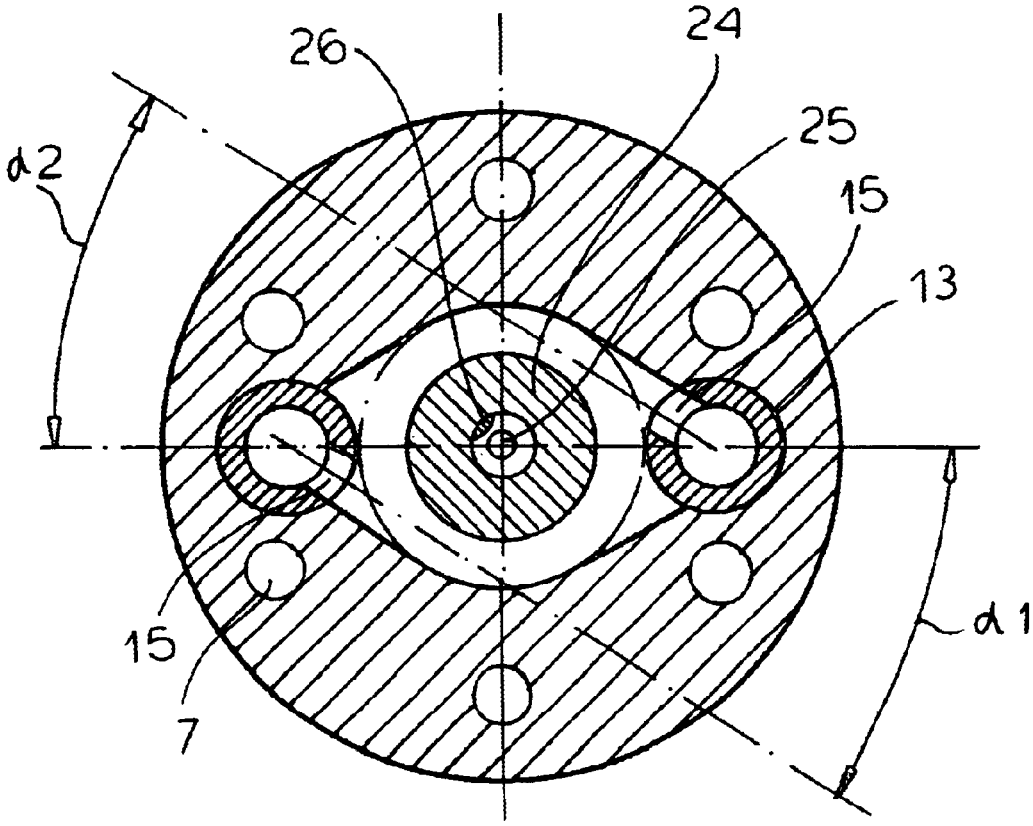
FIG. 2 is a section taken along line Il—Il of FIG. 1.

According to how the adjusters 9 are set, the sizes of the flow cross sections of the slots 14 and 15 vary, as does the amount of turbulence in the joined streams A and B between minimal and maximal values (see FIG. 2). On changing the adjustment angle $\alpha 1$ and/or $\alpha 2$ by means of the adjusters 9 the water-flow speed changes in the slots 15 presuming constant water pressure. An increase of the angles $\alpha 1$ or $\alpha 2$ or of both simultaneously decreases the effective size of the slot 15 and correspondingly increases the flow speed and thus the misting ability of the water. In this case there is a spray with mainly fine droplets that is in particular useful at the start of a fire. A decrease of the angle $\alpha 1$ or $\alpha 2$ or of both simultaneously decreases the water rotation and the flows work against each other. In this case there is a spray that is mainly large droplets.

Figure 4A:
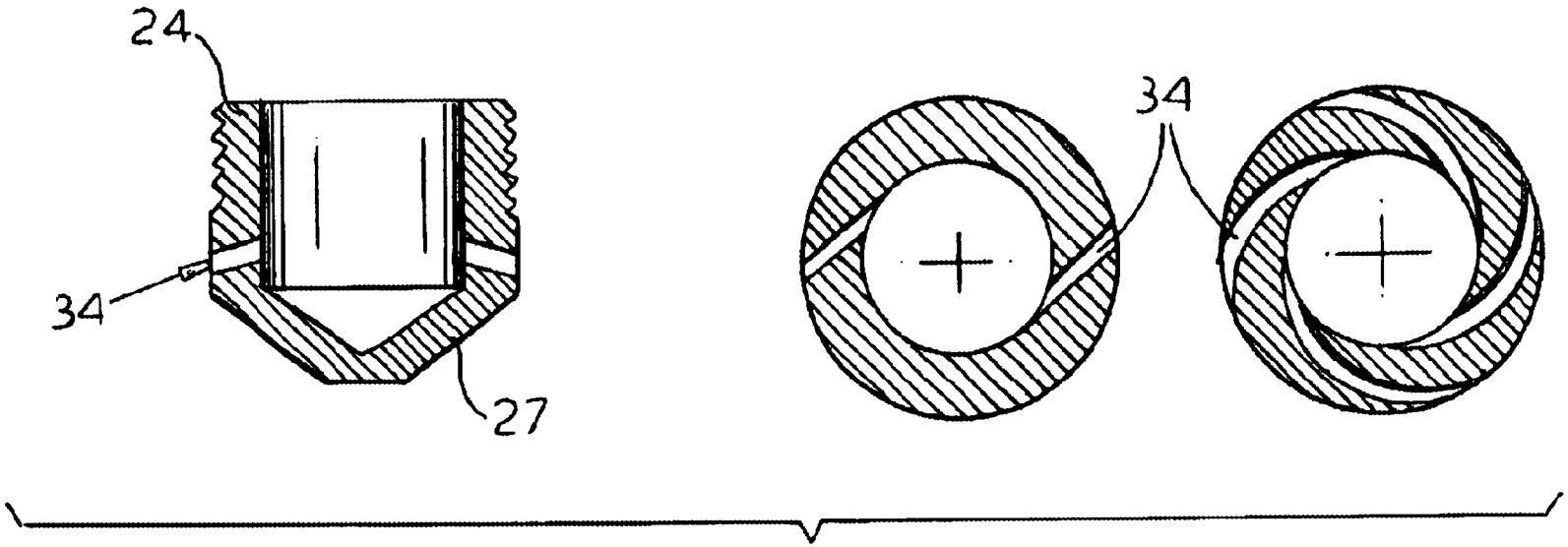
FIGS. 4*a*–4*c* are variations on the flow body.

FIG. 4 shows various embodiments of the flow body 24 with the use of a spiral guide 26. The flow body of FIG. 4*a* has tangential openings 34 in the forms of bores and no central passage 28. The throughflow low passage 25 extends thus through the tangential openings 34 into the turbulence chamber 23.

Figure 4B:
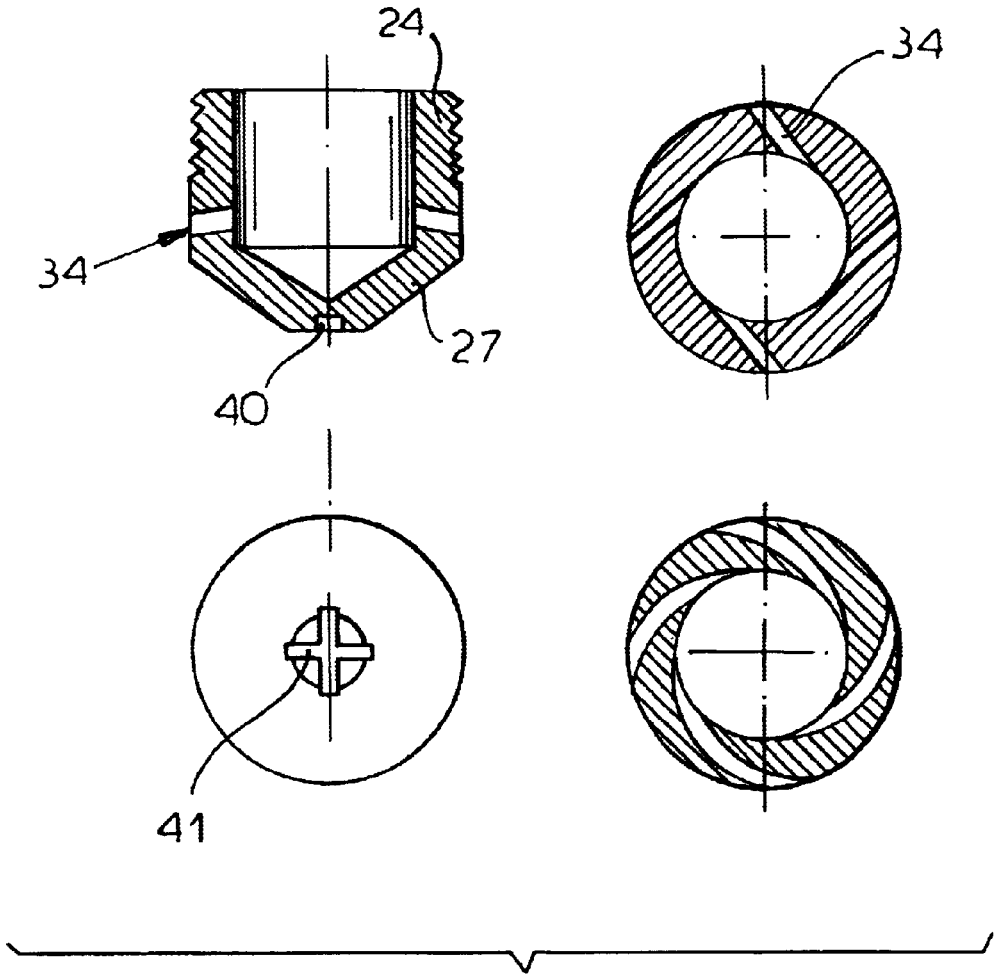
Figure 4C:
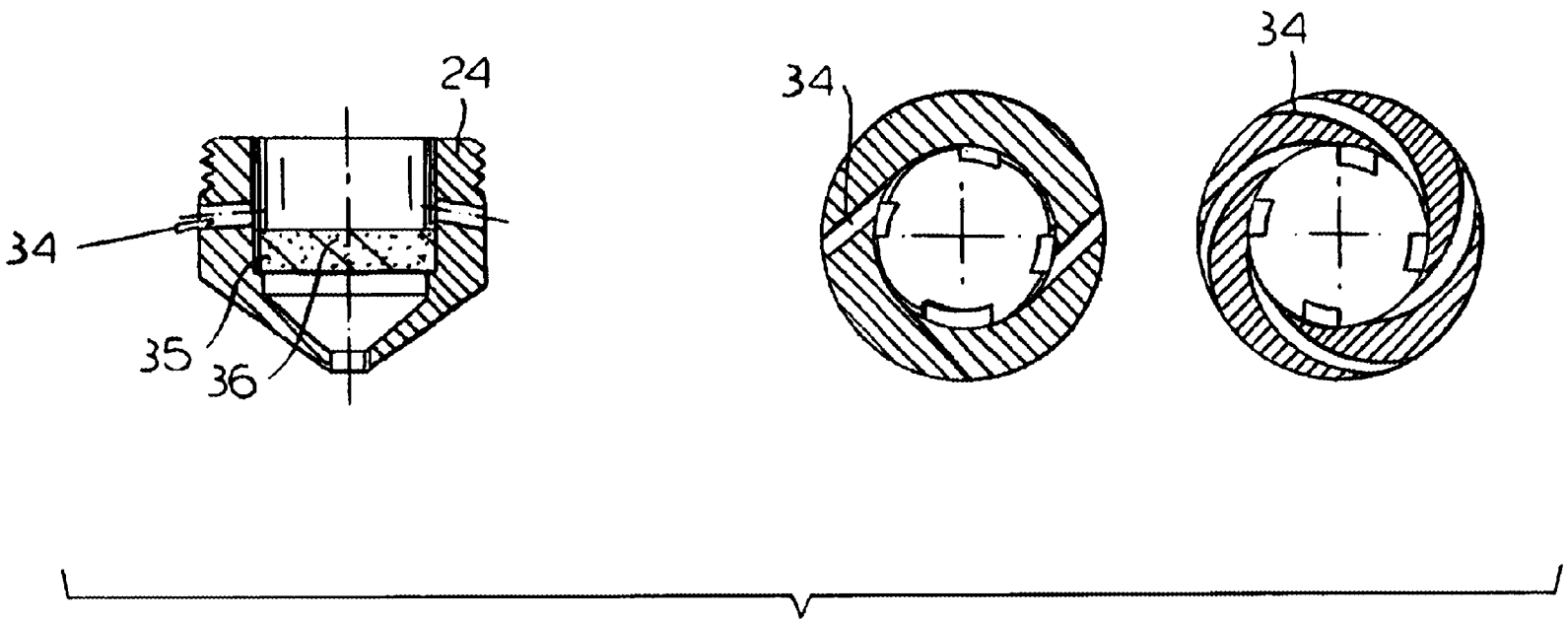
Figure 5:
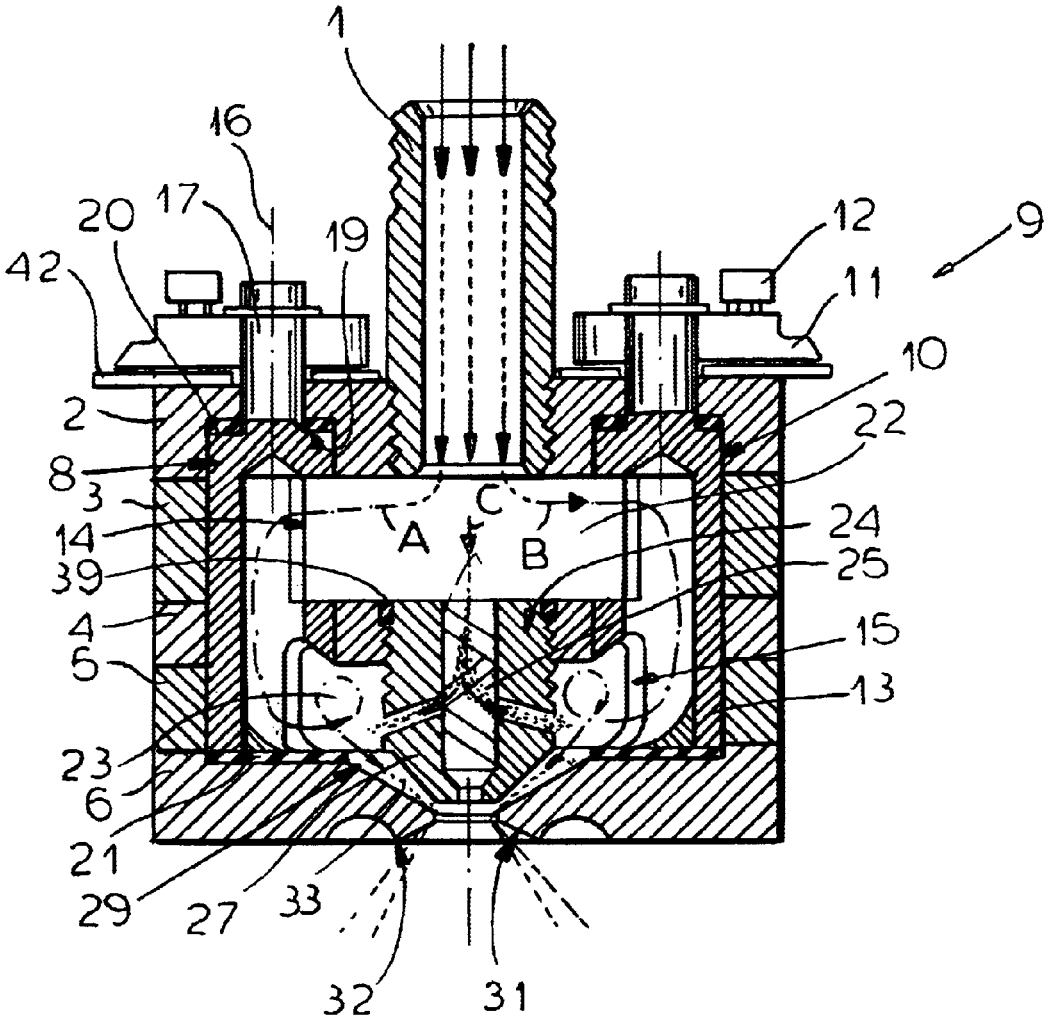
FIG. 5 is a side sectional view of the apparatus according to the invention with a flow body as in FIG. 4*a*.

FIG. 5 shows an apparatus according to the invention in which a flow body according to FIG. 4 is used, which has a hollow spray cone. The incoming water is again subdivided into streams A, B, and C. Streams A and B flow into the turbulence chamber 23. The stream C flows into the flow body 24 and is there subdivided by the tangential openings into streams $C_1$ to $C_n$. The streams $C_{1—Cn}$ join in the turbulence chamber 23 and unit with the streams A and B. The joining of the streams A, B. and $C_{1—Cn}$ takes place in this manner in the turbulence chamber 23 before exiting from the flow passage 34.

FIG. 4*b* shows the flow body 24 having in addition to the tangential openings 34 a slot cutout 40 in the flow-body head 27 or a profiling 41 which extends toward the flow funnel-shaped passage 33 or into it. The cutout 40 or the profiling 41 increases the turbulence of the moving water. Such a flow body produces a full spray cone.

FIG. 4*c* shows a flow body 24 in which an insert 35 with an opening 36 is provided. Such a flow body intensifies the turbulence in the output funnel-shaped passage 33.

Figure 6:
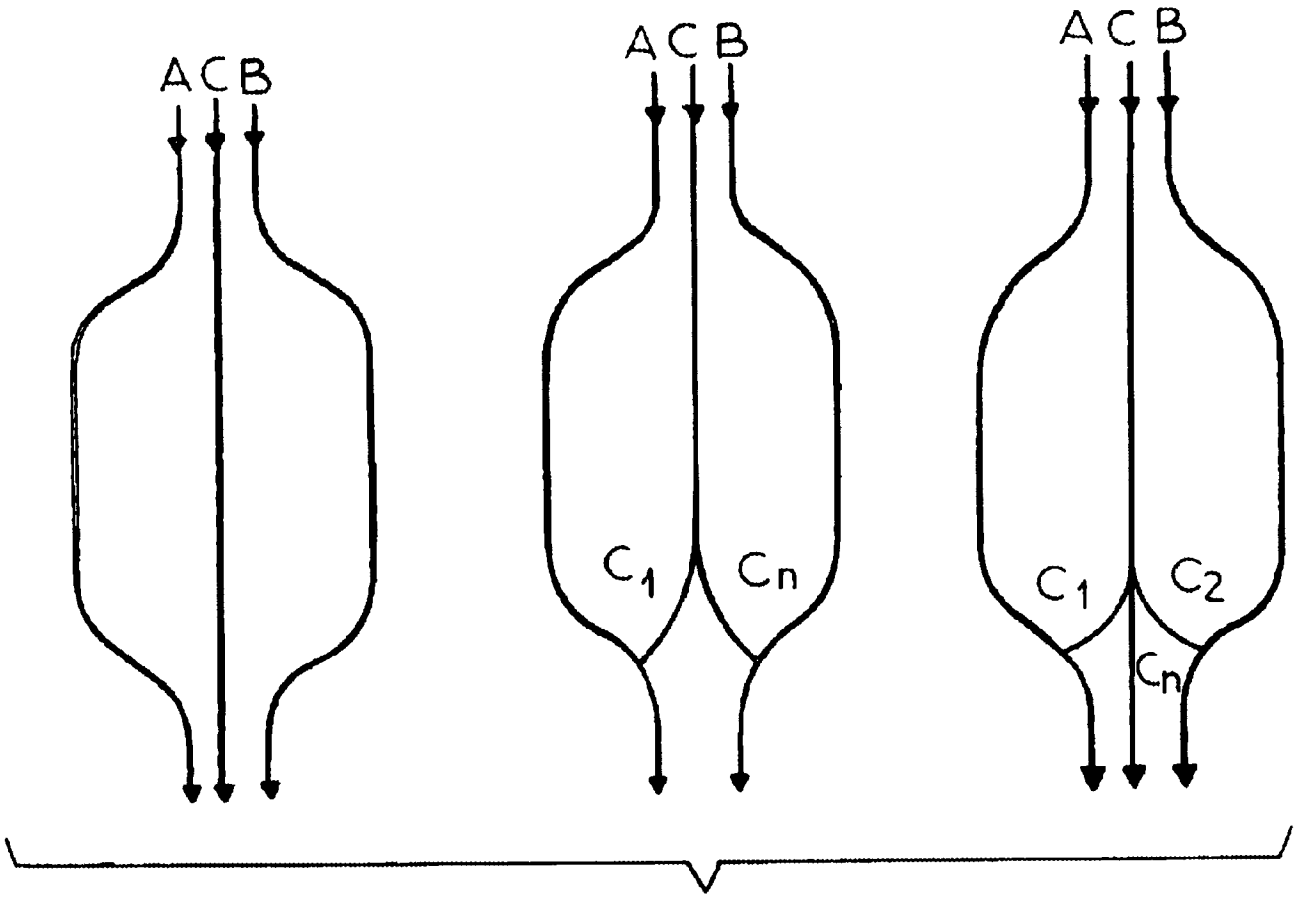
FIG. 6 schematically shows possible variants of the flow of the stream according to the method of the invention.

FIG. 6 illustrates the flow of the partial streams according to the individual variants of FIGS. 4*a* through 4*c*.

What is claimed is:

1. A spray nozzle comprising:

a housing formed with an inlet adapted to be connected to a source of pressurized liquid, an outwardly open outlet spaced from the inlet, a turbulence chamber opening into the outlet, a distributing chamber opening into the inlet, and a throughflow passage extending from adjacent the inlet to adjacent the outlet, whereby liquid from the inlet flows as a primary stream from the inlet through the throughflow passage to adjacent the out-let; and means including a pair of valve bodies in the housing between the distributing chamber and the turbulence chamber for forming respective secondary streams of variable intensity directed tangentially into the turbulence chamber and for combining the secondary streams in the turbulence chamber with the primary stream to project from the outlet a spray cone having a droplet size dependent on the intensities of the secondary streams.

2. The spray nozzle defined in claim 1 wherein the housing is formed with a pair of outer passages extending between the distributing chamber and the turbulence chamber, the valve bodies being in the outer passages.

3. The spray nozzle defined in claim 2 wherein each of the valve bodies has an inlet slot opening at the distributing chamber and an outlet slot opening at the turbulence chamber and is tubular between the slots, whereby the secondary streams flow into the respective inlet slots, through the respective valve bodies, and out the respective outlet slots into the turbulence chamber.

4. The spray nozzle defined in claim 3 wherein each of the valve bodies is pivotal about a respective axis through a multiplicity of angularly offset positions and the respective slots are exposed differently in the positions, whereby the intensity of the secondary streams is determined by the valve-body positions.

5. The spray nozzle defined in claim 4 wherein each of the valve bodies has a small-diameter stem projecting out of the housing and carrying an adjustment arm, whereby actuation of the adjustment arms controls the intensities of the respective secondary streams.

6. The spray nozzle defined in claim 5, further comprising brake means for arresting the adjustment arms relative to the housing.

7. The spray nozzle defined in claim 4 wherein each of the valve bodies is formed with an angled diverting face at the respective outlet slot positioned so as to divert the respective secondary stream tangentially into the distributing chamber.

8. The spray nozzle defined in claim 1 wherein the inlet and outlet are axially aligned and the throughput passage opens centrally into the distributing passage in axial alignment with the inlet.

9. The spray nozzle defined in claim 8 wherein the throughput passage opens axially into the distributing passage in axial alignment with the outlet.

10. The spray nozzle defined in claim 8 wherein the flow body has an outlet opening of substantially smaller flow cross section than the outlet port.

11. The spray nozzle defined in claim 8 wherein the housing includes a flow body forming the throughput passage and formed with a plurality of radially open ports opening radially into the distributing passage at the outlet.

12. The spray nozzle defined in claim 11 wherein the flow body is provided with an internal spiral guide imparting twist to the primary stream.

13. The spray nozzle defined in claim 1 wherein the outlet opening is inwardly flared and formed with a downstream end of the flow body a frustoconical outlet passage opening at the outlet.

14. The spray nozzle defined in claim 1 wherein the outlet passage is of outwardly decreasing flow cross section.

15. The spray nozzle defined in claim 1 wherein the outlet opening is outwardly flared.

16. The spray nozzle defined in claim 1 wherein the outlet opening is outwardly frustoconically flared.

17. The spray nozzle defined in claim 1 wherein the housing is formed by an inlet plate forming the inlet, an outlet plate forming the outlet, a distributing ring fixed to the inlet plate and forming the distributing chamber, a turbulence ring fixed to the outlet plate and forming the turbulence chamber, a spacer ring between the distributing ring and turbulence rings, and bolts sandwiching the plates and rings together.

18. A method of operating a spray nozzle having a housing formed with an inlet adapted to be connected to a source of pressurized liquid, an outwardly open outlet spaced from the inlet, a turbulence chamber opening into the outlet, a distributing chamber opening into the inlet, and a throughflow passage extending from adjacent the inlet to adjacent the outlet, whereby liquid from the inlet flows as a primary stream from the inlet through the throughflow passage to adjacent the outlet; and means including a pair of valve bodies in the housing between the distributing chamber and the turbulence chamber for forming respective secondary streams of variable intensity directed tangentially into the turbulence chamber and for combining the secondary streams in the turbulence chamber with the primary stream to project from the outlet a spray cone having a droplet size dependent on the intensities of the secondary streams, the method comprising the steps of:

at a start of a fire, combining the primary and secondary streams so as to form a fine-droplet spray; and as the fire develops and intensifies, combining the primary and secondary streams to increase the droplet size of the spray.

19. The method defined in claim 18, further comprising the step of detecting a parameter of the fire and generating an output corresponding thereto, the primary and secondary streams being combined in accordance with the output.

20. The method defined in claim 19 wherein the parameter is smoke generated by the fire, the optical appearance of the fire, the temperature generated by the fire, the change of temperature of a space holding the fire, or the flames of the fire.

* * * * *